US011759691B2

(12) United States Patent
Destro

(10) Patent No.: US 11,759,691 B2
(45) Date of Patent: Sep. 19, 2023

(54) TETHERED RESISTANCE SWIM TRAINING APPARATUS WITH SMART PULLEY

(71) Applicant: Destro Machines LLC, Pittsburgh, PA (US)

(72) Inventor: Charles Destro, Pittsburgh, PA (US)

(73) Assignee: Destro Machines LLC, Pittsburgh, PA (US)

( * ) Notice: Subject to any disclaimer, the term of this patent is extended or adjusted under 35 U.S.C. 154(b) by 136 days.

(21) Appl. No.: 17/098,612

(22) Filed: Nov. 16, 2020

(65) Prior Publication Data

US 2021/0146215 A1 May 20, 2021

Related U.S. Application Data

(60) Provisional application No. 62/935,152, filed on Nov. 14, 2019.

(51) Int. Cl.

| | |
|---|---|
| ***A63B 69/12*** | (2006.01) |
| ***A63B 24/00*** | (2006.01) |
| ***A63B 21/00*** | (2006.01) |
| ***A63B 21/062*** | (2006.01) |
| ***A63B 71/06*** | (2006.01) |

(52) U.S. Cl.

CPC ..... *A63B 69/12* (2013.01); *A63B 21/0626* (2015.10); *A63B 21/154* (2013.01); *A63B 21/4001* (2015.10); *A63B 24/0062* (2013.01); *A63B 71/0622* (2013.01); *A63B 2071/0694* (2013.01); *A63B 2220/51* (2013.01); *A63B 2220/833* (2013.01); *A63B 2225/50* (2013.01); *A63B 2225/60* (2013.01)

(58) Field of Classification Search

CPC ..... A63B 22/0076–0089; A63B 21/062–0632

See application file for complete search history.

(56) References Cited

U.S. PATENT DOCUMENTS

| | | | | |
|---|---|---|---|---|
| 3,861,675 A * | 1/1975 | Hopper | A63B 69/12 | 482/55 |
| 4,921,244 A * | 5/1990 | Berroth | A63B 21/0058 | 482/901 |
| 5,938,565 A * | 8/1999 | Bernacki | A63B 21/153 | 434/247 |
| 8,388,502 B2 * | 3/2013 | Tedhams | A63B 69/12 | 482/56 |
| 9,265,990 B2 * | 2/2016 | Reese | A63B 35/00 | |

(Continued)

*Primary Examiner* — Nyca T Nguyen

(74) *Attorney, Agent, or Firm* — STEPTOE & JOHNSON PLLC; Jeffrey Mulrooney

(57) ABSTRACT

The present invention is a tethered resistance swim training apparatus with a pulley that includes an electronic tachometer to measure the rotations of the wheel of the pulley and strain gauge to measure the force pulling on the body of the pulley. The pulley, also referred to as "smart pulley", can be implemented in many tethered swim training apparatuses of different arrangements. With the tachometer and strain gauge the power and other performance metrics can be calculated while a swimmer is using the apparatus. A load cell or similar can be used in place of a strain gauge. The sensors may be connected via wired or wireless communications to a computer (tablet, laptop, personal computer, server, or the like) for processing of the signals and display on an electronic display.

14 Claims, 8 Drawing Sheets

(56) References Cited

U.S. PATENT DOCUMENTS

| | | | | |
|---|---|---|---|---|
| 9,604,088 | B2 * | 3/2017 | Djang | A63B 21/0606 |
| 10,307,654 | B2 * | 6/2019 | Chuang | A63B 71/0622 |
| 10,953,266 | B2 * | 3/2021 | Leopoldo da Camara Filho | G06F 3/0416 |
| 11,235,193 | B1 * | 2/2022 | McConachie | A63B 21/4009 |
| 11,305,170 | B2 * | 4/2022 | Destro | A63B 21/154 |
| 2009/0013804 | A1 * | 1/2009 | Hanoun | G01L 5/106 482/1 |
| 2011/0028278 | A1 * | 2/2011 | Roach | A63B 22/0076 482/72 |
| 2011/0152045 | A1 * | 6/2011 | Horne | A63B 21/0628 482/131 |
| 2014/0235409 | A1 * | 8/2014 | Salmon | A63B 21/0724 482/8 |
| 2014/0274566 | A1 * | 9/2014 | Draper | A63B 24/0062 482/8 |
| 2018/0345080 | A1 * | 12/2018 | Orfield | A63B 71/0622 |
| 2019/0160324 | A1 * | 5/2019 | Leopoldo Da Camara Filho | B66D 1/485 |
| 2019/0293480 | A1 * | 9/2019 | Burck | G01G 23/012 |
| 2019/0344123 | A1 * | 11/2019 | Rubin | A63B 24/0062 |
| 2020/0376357 | A1 * | 12/2020 | Destro | A63B 21/154 |
| 2021/0077849 | A1 * | 3/2021 | Wehrell | A63B 21/063 |
| 2021/0402256 | A1 * | 12/2021 | Huch | A63B 24/0062 |

* cited by examiner

TETHERED RESISTANCE SWIM TRAINING APPARATUS WITH SMART PULLEY

CROSS-REFERENCE TO RELATED APPLICATIONS

This application is based on and claims priority to U.S. Provisional Patent Application No. 62/935,152 filed Nov. 14, 2019 entitled "TETHERED RESISTANCE SWIM TRAINING APPARATUS WITH SMART PULLEY"

BACKGROUND OF THE INVENTION

The present invention relates to an aquatic exercise system and more particularly pertains to applying a resistive force to an exercising swimmer and measuring the performance of a swimmer under such circumstances. Prior devices including U.S. Pat. No. 3,861,675 to Hopper, U.S. Pat. No. 9,265,990 to Reese et al., and U.S. Pat. No. 9,604,088 to Djang have endeavored to provide a system for excising in this matter, and those disclosures are herein incorporated by reference but none have considered measuring performance of a swimmer.

Prior art systems and devices in the field of tethered resistance swim training do not provide quantitative measures of swimming performance, such as force, power, or impulse. An object of the present invention is to eliminate or at least mitigate the above shortcomings in the art.

SUMMARY OF THE INVENTION

The present invention in at least one embodiment is a tethered resistance swim training apparatus with a pulley that includes an electronic tachometer to measure the rotations of the wheel of the pulley and strain gauge to measure the force pulling on the body of the pulley. The pulley, also referred to as "smart pulley", can be implemented in many tethered swim training apparatuses of different arrangements. With the tachometer and strain gauge the power and other performance metrics can be calculated while a swimmer is using the apparatus. A load cell or similar can be used in place of a strain gauge. The sensors may be connected via wired or wireless communications to a computer (tablet, laptop, personal computer, server, or the like) for processing of the signals and display on an electronic display. Alternatively or additionally, depending on the specific embodiment the pulley housing itself contains a computer for processing of the signals and for displaying related metrics on an electronic display incorporated into the housing of the pulley or combination thereof. The electronic components of the present invention may be powered by an internal battery or battery pack in lieu of or in addition to a wired power connection to a wall outlet via an appropriate transformer.

In one embodiment the invention is an aquatic exercise apparatus for applying a resistive force to an exercising swimmer, the apparatus including: a first bracket positioned above a pool of water; a container; an operational assembly including at least one upper pulley attached to the first bracket and at least one lower pulley attached to the container, a third pulley attached to a second bracket, the third pulley including an tachometer configured to measure the rotation of the third pulley; a cord passing through the at least one upper pulley, the at least one lower pulley, and the third pulley; a fastener configured to attach to an animal, where the fastener is attached to a free end of the cord; and where pulling the free end of the cord moves the container upward against gravity. In another embodiment the third pulley includes a microcontroller in electrical communication with the tachometer, and a battery in electrical communication with the microcontroller and the tachometer. In yet another embodiment the third pulley further includes a strain gauge disposed at the attachment to the second bracket, and where the strain gauge is in electrical communication with the battery, the microcontroller, and the tachometer. In still another embodiment the third pulley further includes a load cell disposed at the attachment to the second bracket, and where the load cell is in electrical communication with the battery, the microcontroller, and the tachometer. In still another embodiment the third pulley further includes a wireless network module in electrical communication with the battery, the microcontroller, and the tachometer. In yet still another embodiment the third pulley includes an electronic display, where the electronic display is in electrical communication with the battery, the microcontroller, and the tachometer. In still yet another embodiment the electronic display is a touch screen interface. In but another embodiment the tachometer measures the rotation of the third pulley via magnets embedded in the third pulley. In but yet another embodiment the tachometer is encapsulated by a material configured to prevent water intrusion.

In another embodiment the invention is an aquatic exercise apparatus for applying a resistive force to an exercising swimmer, the apparatus including: a first bracket positioned above a pool of water; a container; an operational assembly including at least one upper pulley attached to the first bracket and at least one lower pulley attached to the container, a third pulley attached to a second bracket, the third pulley including an tachometer, a microcontroller in electrical communication with the tachometer, a battery in electrical communication with the microcontroller and the tachometer; a cord passing through the at least one upper pulley, the at least one lower pulley, and the third pulley; a fastener configured to attach to an animal, where the fastener is attached to a free end of the cord; where pulling the free end of the cord moves the container upward against gravity; where the tachometer is configured to measure the rotation of the third pulley via magnets embedded in the third pulley; and where the microcontroller is configured to calculate a metric of power from at least one signal received from the tachometer. In but another embodiment the third pulley further includes a strain gauge disposed at the attachment to the second bracket, and where the strain gauge is in electrical communication with the battery, the microcontroller, and the tachometer. In yet another embodiment the third pulley further includes a load cell disposed at the attachment to the second bracket, and where the load cell is in electrical communication with the battery, the microcontroller, and the tachometer. In yet, but another embodiment the third pulley further includes a wireless network module in electrical communication with the battery, the microcontroller, and the tachometer. In yet still another embodiment the third pulley includes an electronic display, where the electronic display is in electrical communication with the battery, the microcontroller, and the tachometer. In but still yet another embodiment the electronic display is a touch screen interface. In still another embodiment the tachometer measures the rotation of the third pulley via magnets embedded in the third pulley. In but yet another embodiment the tachometer is encapsulated by a material configured to prevent water intrusion.

DETAILED DESCRIPTION OF THE INVENTION

Figure 1:
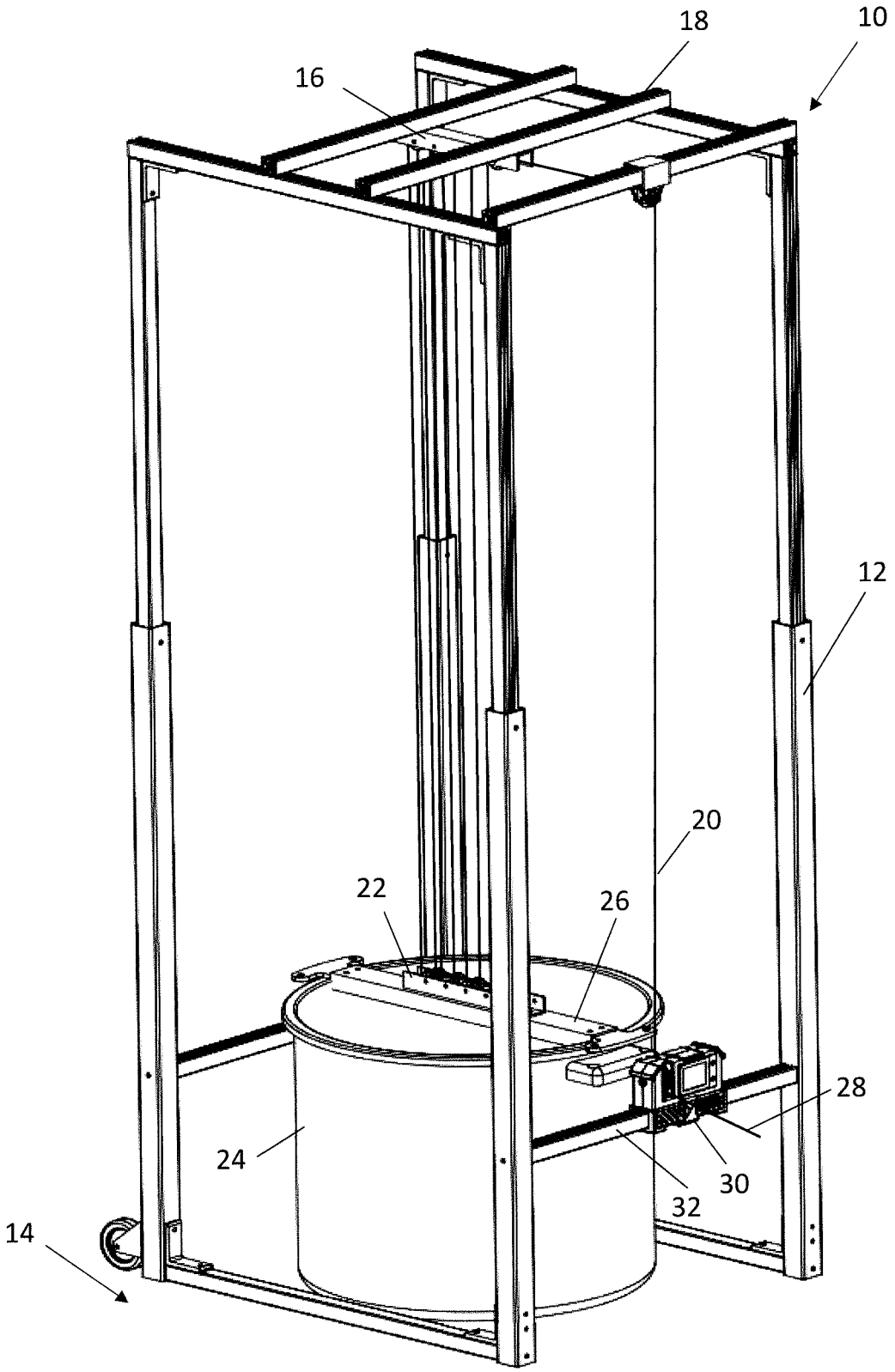
FIG. 1 is an overall isometric view of an embodiment of the tethered resistance swim training apparatus with the smart pulley attached to a lower bracket of the apparatus.

Prior to proceeding with the more detailed description of the present invention it should be noted that, for the sake of clarity, identical components which have identical functions have been designated by identical reference numerals throughout the several views illustrated in the drawings.

Figure 2:
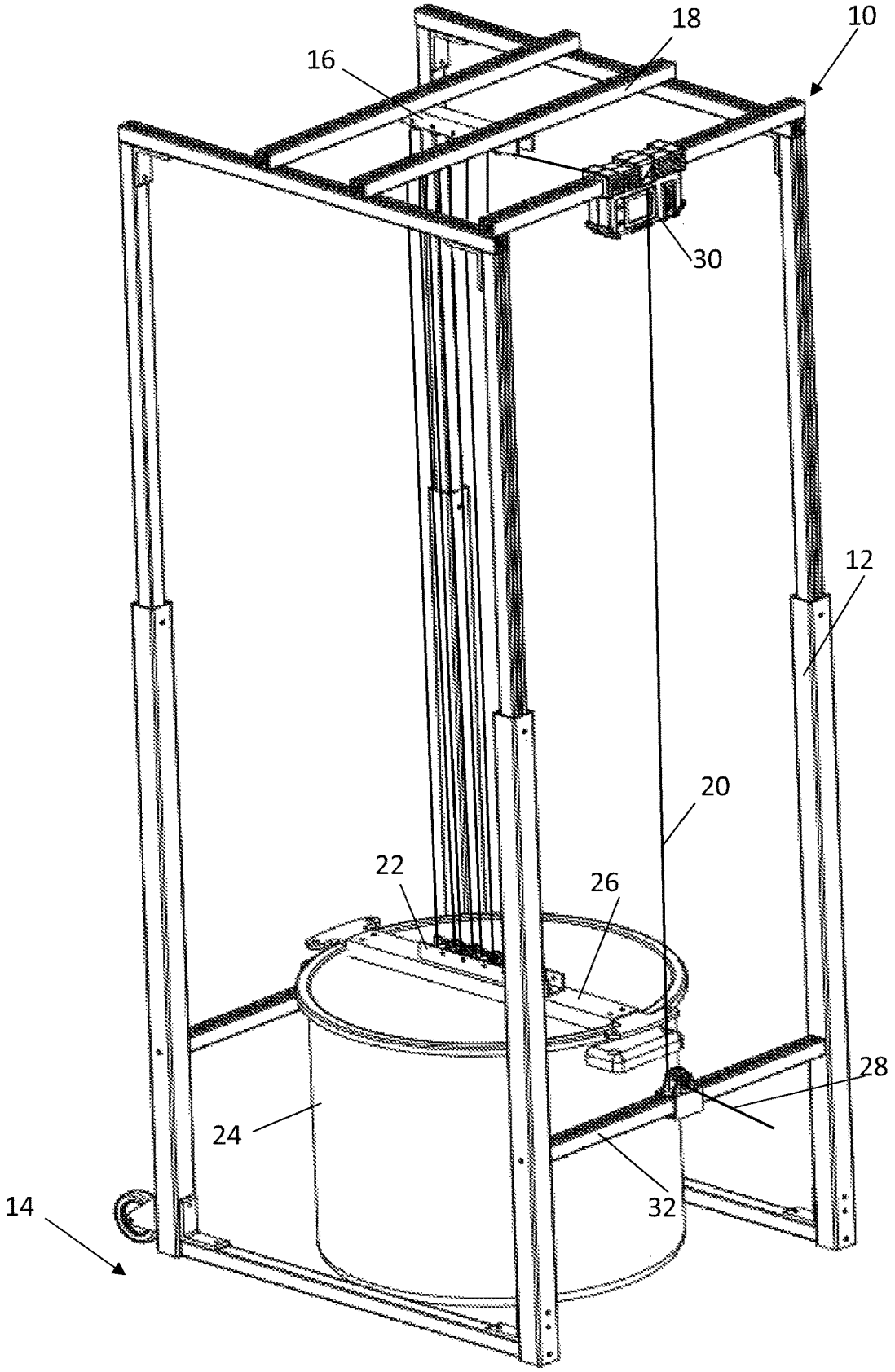
FIG. 2 is an overall isometric view of an embodiment of the tethered resistance swim training apparatus with the smart pulley attached to an upper bracket of the apparatus.
Figure 3:
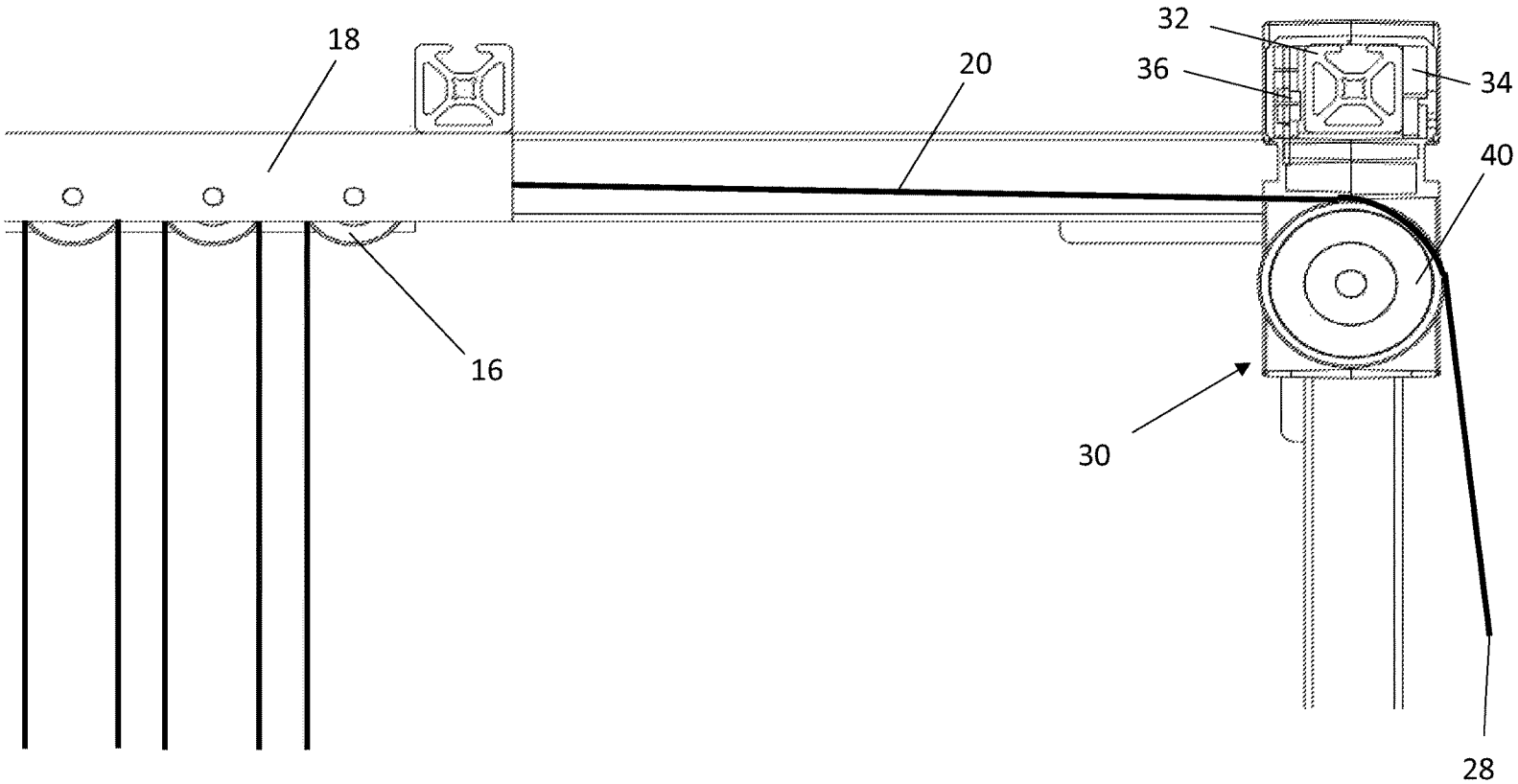
FIG. 3 is a side cross sectional view the upper portion of an embodiment of the tethered resistance swim training apparatus with the smart pulley attached to an upper bracket of the apparatus.
Figure 4:
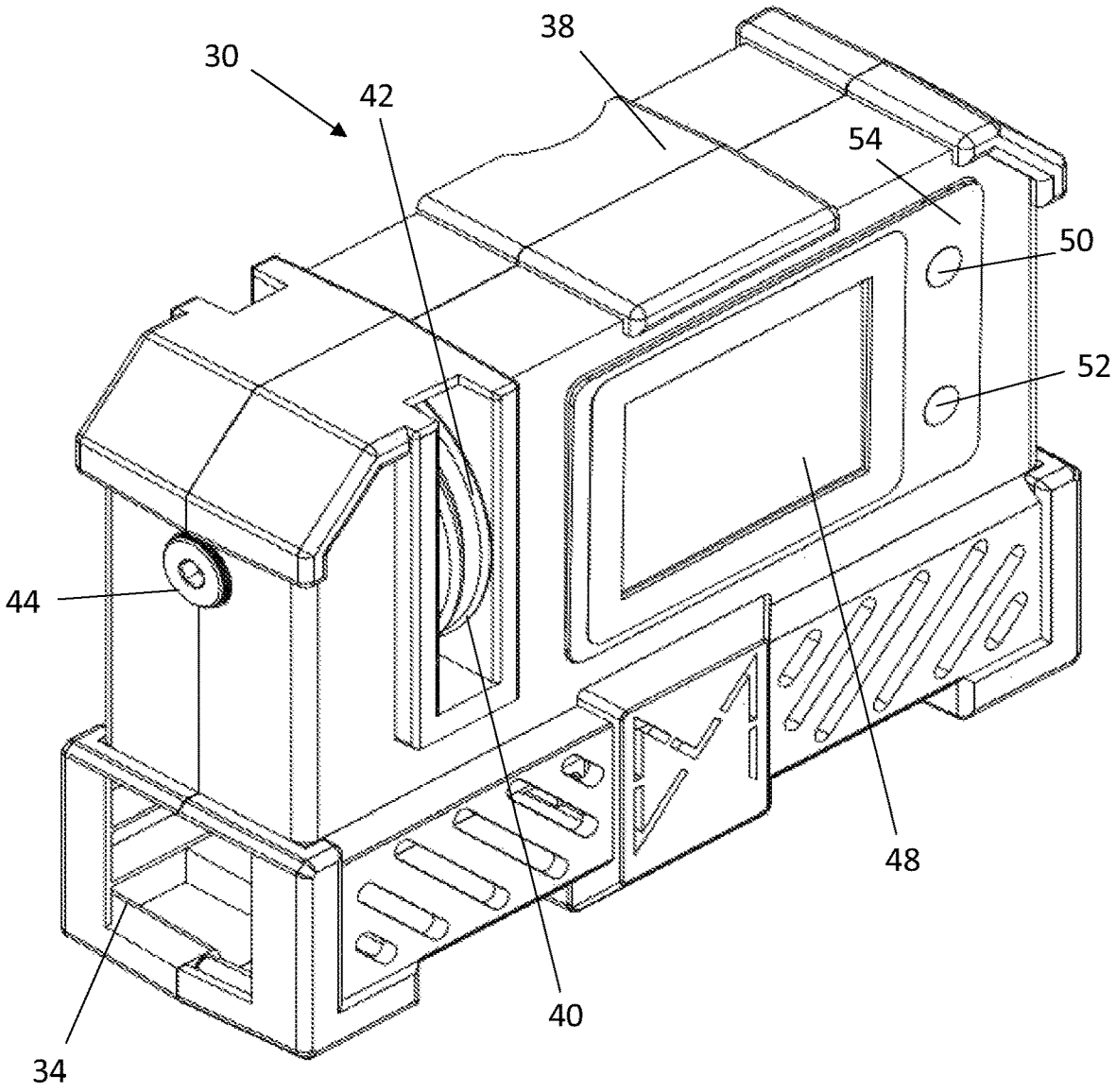
FIG. 4 is an isometric view of an embodiment of the pulley of the tethered resistance swim training apparatus.
Figure 5:
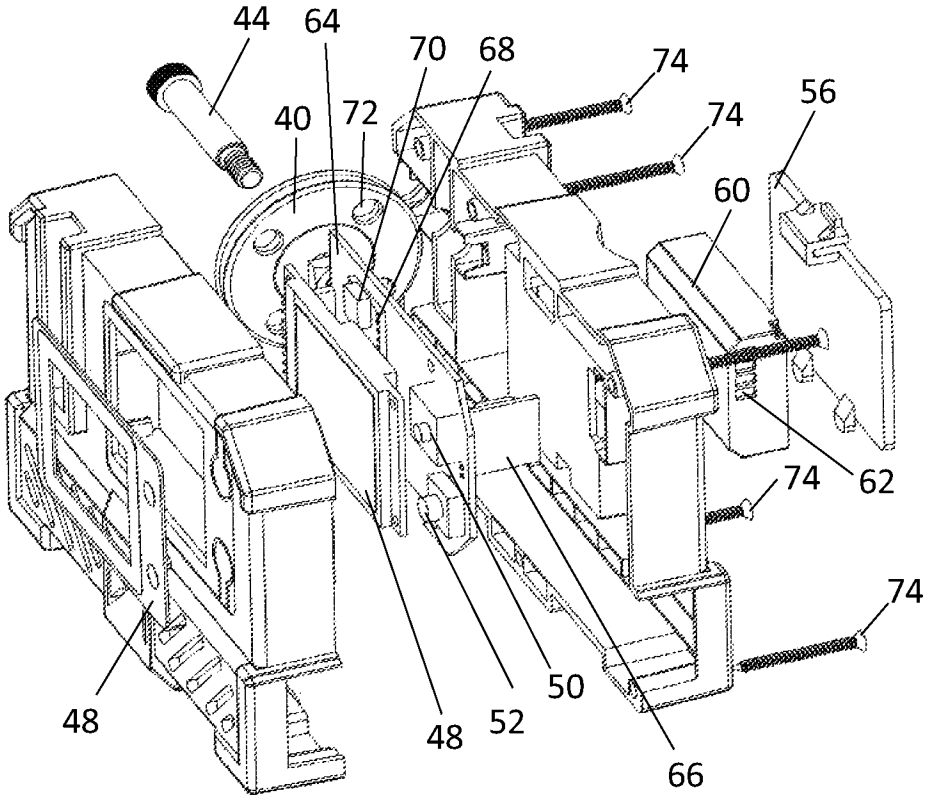
FIG. 5 is an isometric exploded view of an embodiment of the pulley (shown in FIG. 4) of the tethered resistance swim training apparatus.
Figure 6:
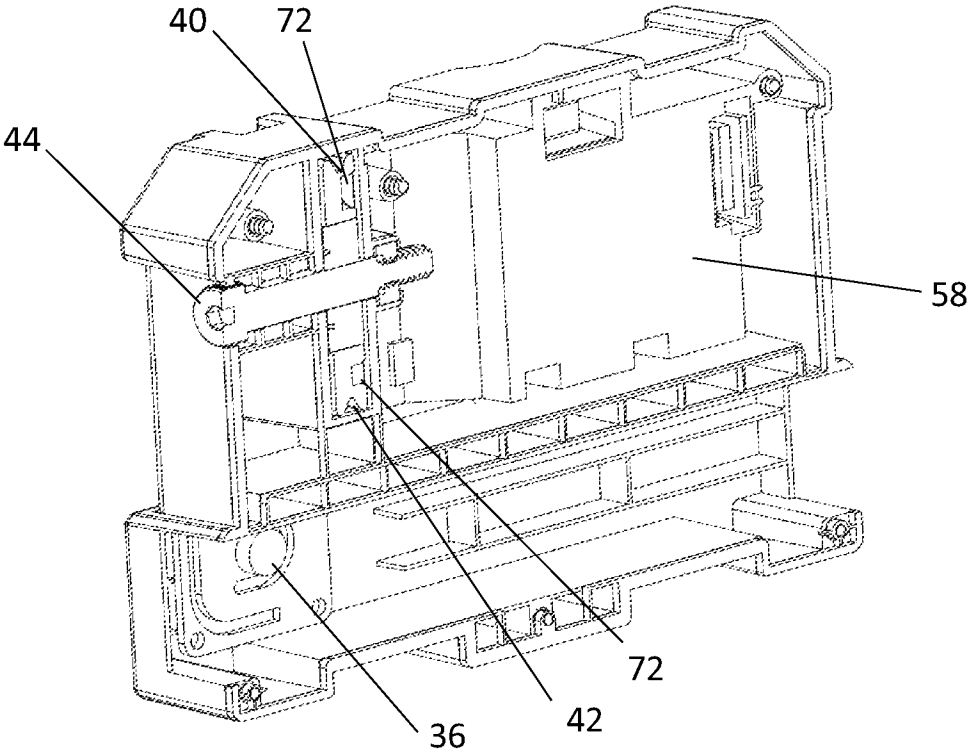
FIG. 6 is an isometric cross sectional view of an embodiment of the pulley (shown in FIG. 4) of the tethered resistance swim training apparatus.
Figure 7:
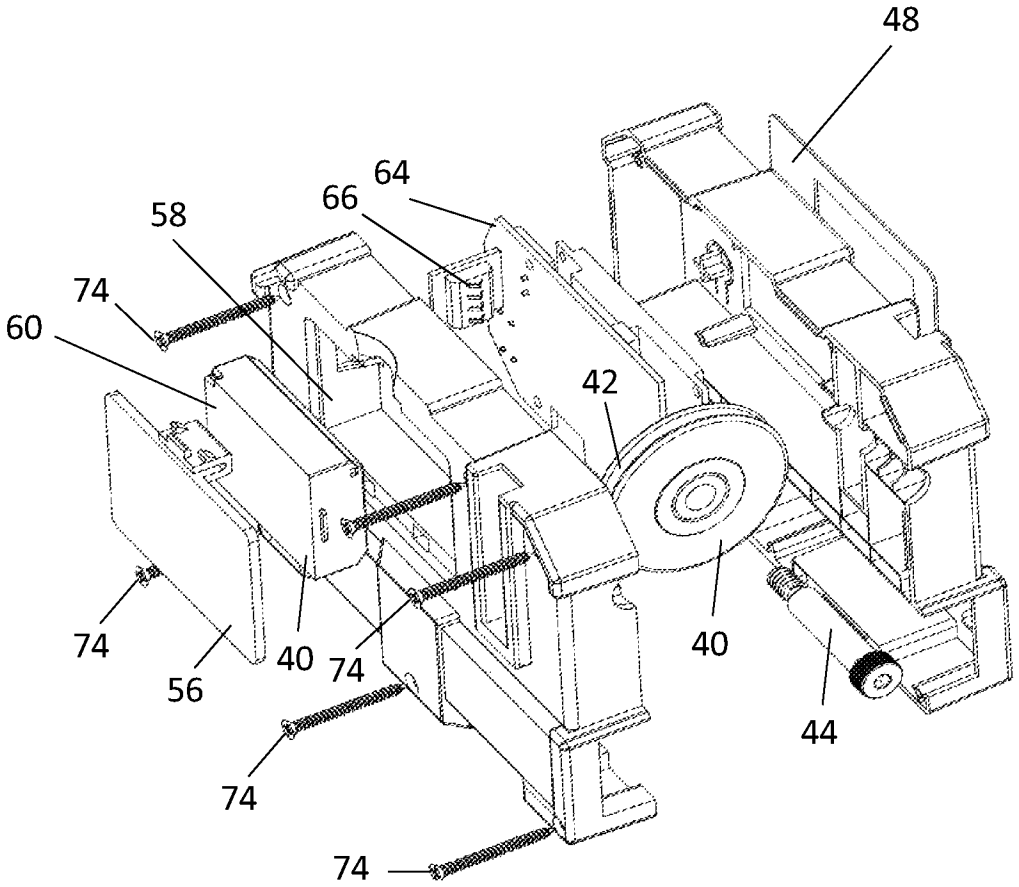
FIG. 7 is an isometric exploded view of an embodiment of the pulley (shown in FIG. 4) of the tethered resistance swim training apparatus.
Figure 8:
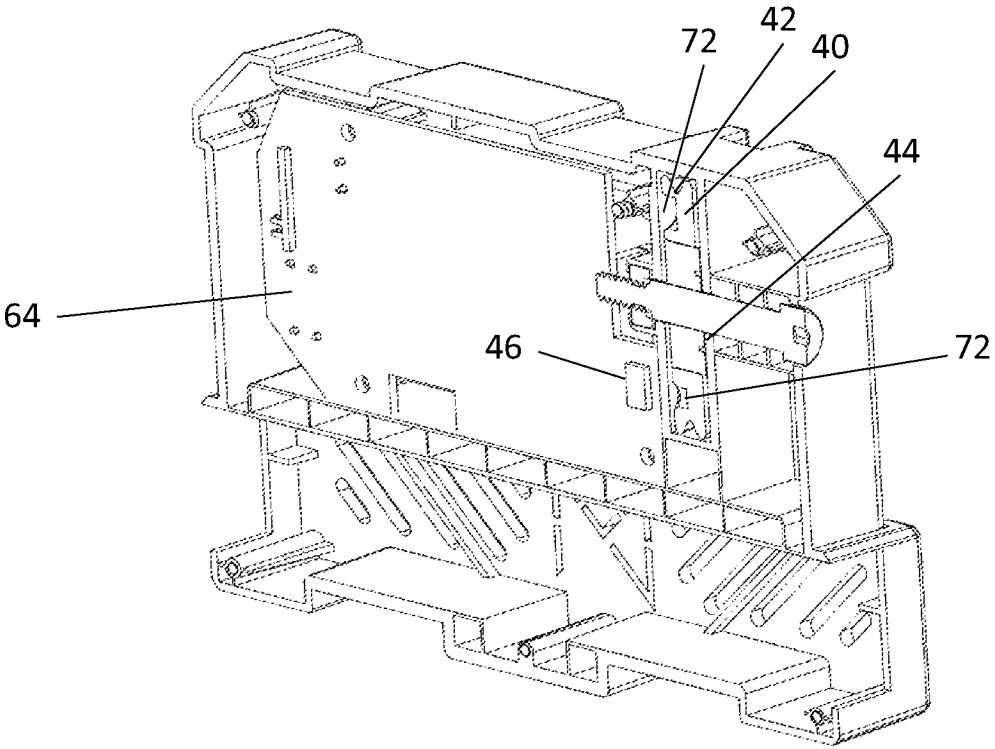
FIG. 8 is an isometric cross sectional view of an embodiment of the pulley (shown in FIG. 4) of the tethered resistance swim training apparatus.

Referring in particular to FIGS. 1-8, in a first aspect the present invention provides an apparatus, generally designated 10, including tower 12 resting or mounted to floor 14. Tower 12 includes top pulleys 16 mounted to first bracket 18 with cord 20 passing through both top pulley 16 and bottom pulleys 22 which are attached to bucket 24 via second bracket 26. The free end 28 of cord 20 is routed through smart pulley 30 and attached to a swimmer (not shown) in a swimming pool (not shown) so that bucket 24 moves against gravity to provide resistance to pulling at free end 28 of cord 20. Smart pulley 30 is attached to tower 12 via third bracket 32. Smart pulley 30 may be attached to third bracket 32 at an upper portion of the tower 12 as shown in FIG. 1, or smart pulley 30 may be attached to third bracket 32 at lower portion of the tower 12 as shown in FIG. 2. Having smart pulley 30 attached to third bracket 32 at lower portion of the tower 12 as shown in FIG. 2 is envisioned to be preferable for use by a user who is in a pool while using. While having smart pulley 30 attached to third bracket 32 at upper portion of the tower 12 as shown in FIG. 1 is envisioned to be preferable for use by a user who is outside the pool while using, for example a swim coach while the swimmer exercises. The smart pulley 30 includes an integrated slot 34 to aid in attachment to third bracket 32. This means of attachment may be modified in order to accept any suitable geometry. Smart pulley 30 also includes strain gauge 36 between slot 34 and body 38 of the smart pulley 30 in order to measure strain or the force pulling on pulley 30. Within body 38 is wheel 40 with groove 42 which rotates on axle 44. The rotation of wheel 40 is measured via tachometer 46. Tachometer 46 may be a magnetic sensor or optical sensor able to measure the rotation of wheel 40.

Referring more particularly to FIGS. 4-8, the smart pulley 30 of this embodiment includes electronic display 48, power button 50, and tactile button 52 which collectively make up the user interface physically on the smart pulley 30. Screen frame 54 engages with body 38 to provide a water tight seal to protect electrical components within body 38. Battery cover 56 covers battery compartment 58 which is configured to hold battery pack 60. Battery cover 56 is preferably configured with body 30 to provide a water tight seal for battery compartment 58 when snapped in place. Battery contacts 62 on battery pack 60 are configured to provide power to printed circuit board 64 via electrical contacts 66. Printed circuit board 64 electrically connects the electrical components of smart pulley 30, including strain gauge 36, tachometer 46, display 48, power button 50, tactile button 52, battery pack 60, electrical contacts 66, microcontroller 68, and wireless network module 70. Microcontroller 68 may be a central processing unit, a chipset, computer, or any suitable microelectronic system or device configured to control the electrical components. To aid in water and dust protection, the above electrical components and printed circuit board 64 may be encapsulated with a polymer, thermoplastic, or other suitable material known in the art. The wheel 40 shown in this embodiment includes magnets 72. Movement of the wheel 40 and magnets 72 are sensed by tachometer 46 which is in electrical communication with microcontroller 68. The body 38 is held together via screws 74.

While presently preferred embodiments of the present invention has been described in detail above, it should be understood that various other adaptations and/or modifications of the invention can be made by those persons who are particularly skilled in the art without departing from either the spirit of the invention or the scope of the appended claims.

What is claimed is:

1. An aquatic exercise apparatus for applying a resistive force to an exercising swimmer, the apparatus comprising:

a first bracket positioned above a pool of water;

a container;

an operational assembly comprising at least one upper pulley attached to the first bracket and at least one lower pulley attached to the container, a third pulley attached to a second bracket, the third pulley comprising a tachometer configured to measure the rotation of the third pulley;

a cord passing through the at least one upper pulley, the at least one lower pulley, and the third pulley;

a fastener configured to attach to an animal, wherein the fastener is attached to a free end of the cord;

wherein pulling the free end of the cord moves the container upward against gravity;

wherein the third pulley comprises a microcontroller in electrical communication with said tachometer, and a battery in electrical communication with said microcontroller and said tachometer;

wherein the third pulley comprises an electronic display;

wherein said electronic display is in electrical communication with said battery, said microcontroller, and said tachometer; and wherein the axis of rotation of the third pulley is parallel to a screen interface plane of said electronic display.

2. The aquatic exercise apparatus of claim 1, wherein the third pulley further comprises a strain gauge disposed at an attachment to the second bracket, and wherein said strain gauge is in electrical communication with said battery, said microcontroller, and said tachometer.

3. The aquatic exercise apparatus of claim 1, wherein the third pulley further comprises a load cell disposed at an attachment to the second bracket, and wherein said load cell is in electrical communication with said battery, said microcontroller, and said tachometer.

4. The aquatic exercise apparatus of claim 1, wherein the third pulley further comprises a wireless network module in electrical communication with said battery, said microcontroller, and said tachometer.

5. The aquatic exercise apparatus of claim 1, wherein said electronic display is a touch screen interface.

6. The aquatic exercise apparatus of claim 1, wherein the tachometer measures the rotation of the third pulley via magnets embedded in the third pulley.

7. The aquatic exercise apparatus of claim 1, wherein the tachometer is encapsulated by a material configured to prevent water intrusion.

8. An aquatic exercise apparatus for applying a resistive force to an exercising swimmer, the apparatus comprising:

a first bracket positioned above a pool of water;

a container;

an operational assembly comprising at least one upper pulley attached to the first bracket and at least one lower pulley attached to the container, a third pulley attached to a second bracket, the third pulley comprising an tachometer, a microcontroller in electrical communication with said tachometer, a battery in electrical communication with said microcontroller and said tachometer;

a cord passing through the at least one upper pulley, the at least one lower pulley, and the third pulley;

a fastener configured to attach to an animal, wherein the fastener is attached to a free end of the cord;

wherein pulling the free end of the cord moves the container upward against gravity;

wherein the tachometer is configured to measure the rotation of the third pulley via magnets embedded in said third pulley;

wherein the microcontroller is configured to calculate a metric of power from at least one signal received from the tachometer;

wherein the third pulley comprises an electronic display, wherein said electronic display is in electrical communication with said battery, said microcontroller, and said tachometer; and wherein the axis of rotation of the third pulley is parallel to a screen interface plane of said electronic display.

9. The aquatic exercise apparatus of claim 8, wherein the third pulley further comprises a strain gauge disposed at an attachment to the second bracket, and wherein said strain gauge is in electrical communication with said battery, said microcontroller, and said tachometer.

10. The aquatic exercise apparatus of claim 8, wherein the third pulley further comprises a load cell disposed at an attachment to the second bracket, and wherein said load cell is in electrical communication with said battery, said microcontroller, and said tachometer.

11. The aquatic exercise apparatus of claim 8, wherein the third pulley further comprises a wireless network module in electrical communication with said battery, said microcontroller, and said tachometer.

12. The aquatic exercise apparatus of claim 8, wherein said electronic display is a touch screen interface.

13. The aquatic exercise apparatus of claim 8, wherein the tachometer measures the rotation of the third pulley via magnets embedded in the third pulley.

14. The aquatic exercise apparatus of claim 8, wherein the tachometer is encapsulated by a material configured to prevent water intrusion.

* * * * *